US007506770B2

(12) United States Patent
Rief

(10) Patent No.: US 7,506,770 B2
(45) Date of Patent: Mar. 24, 2009

(54) POOL CLEANER STORAGE DEVICE

(75) Inventor: Dieter J. Rief, Santa Rosa, CA (US)

(73) Assignee: Poolvergnuegen, Santa Rosa, CA (US)

( * ) Notice: Subject to any disclaimer, the term of this patent is extended or adjusted under 35 U.S.C. 154(b) by 0 days.

(21) Appl. No.: 11/770,831

(22) Filed: Jun. 29, 2007

(65) Prior Publication Data

US 2008/0000854 A1 Jan. 3, 2008

Related U.S. Application Data

(60) Provisional application No. 60/817,729, filed on Jun. 30, 2006.

(51) Int. Cl.
*A47F 7/00* (2006.01)

(52) U.S. Cl. ..... 211/70.6

(58) Field of Classification Search ..... 211/70.6, 211/60.1, 87.01, 88.01, 65, 89.01; 248/75–77, 248/79, 80, 89, 90

See application file for complete search history.

(56) References Cited

U.S. PATENT DOCUMENTS

| | | | | | |
|---|---|---|---|---|---|
| 3,269,550 | A | * | 8/1966 | Marcus | 211/70.6 |
| 3,650,407 | A | * | 3/1972 | Benham, Jr. | 211/14 |
| 4,049,126 | A | * | 9/1977 | Halverson | 211/104 |
| D259,313 | S | | 5/1981 | Nordlund | |
| D259,314 | S | | 5/1981 | Nordlund | |
| D260,830 | S | * | 9/1981 | Trouba | D6/552 |
| 4,583,647 | A | * | 4/1986 | Schinzing | 211/60.1 |
| 4,923,202 | A | * | 5/1990 | Breveglieri et al. | 280/47.35 |
| D325,488 | S | | 4/1992 | Sheriff | |
| 5,375,726 | A | | 12/1994 | Lechleiter | |
| 5,485,931 | A | | 1/1996 | Barr, Jr. | |
| D372,827 | S | * | 8/1996 | Roche et al. | D6/567 |
| D377,310 | S | | 1/1997 | Crump, Jr. | |
| 5,615,782 | A | | 4/1997 | Choe | |
| 5,678,700 | A | * | 10/1997 | Crosson, Jr. | 211/70.8 |
| 5,690,235 | A | | 11/1997 | Matzen | |
| D394,775 | S | * | 6/1998 | Anderson et al. | D6/574 |
| 5,794,799 | A | * | 8/1998 | Collins et al. | 211/70.6 |
| 5,890,605 | A | | 4/1999 | Percudani | |
| 5,988,408 | A | | 11/1999 | Evans et al. | |
| 6,003,184 | A | * | 12/1999 | Campbell et al. | 15/1.7 |
| 6,089,383 | A | * | 7/2000 | Heneveld | 211/14 |
| 6,102,215 | A | | 8/2000 | Guida | |
| 6,415,932 | B1 | | 7/2002 | Fiscus et al. | |
| 6,749,074 | B1 | * | 6/2004 | Hileman et al. | 211/85.7 |
| 6,752,278 | B2 | * | 6/2004 | Craft et al. | 211/85.7 |
| D498,963 | S | | 11/2004 | Sung-Feng | |
| 6,863,185 | B2 | | 3/2005 | Mele et al. | |
| 2005/0056486 | A1 | * | 3/2005 | Butler et al. | 182/129 |
| 2006/0102569 | A1 | * | 5/2006 | Laga | 211/70.6 |
| 2006/0118498 | A1 | * | 6/2006 | Gilpatrick et al. | 211/70.6 |

* cited by examiner

*Primary Examiner*—Jennifer E. Novosad
(74) *Attorney, Agent, or Firm*—Jansso Shupe & Munger Ltd.

(57) ABSTRACT

The wall-mountable device for convenient and compact storage of an automatic pool cleaner and related hose sections. The wall-mountable device includes a body which has a shelf portion with a substantially-vertical upper surface sized to receive the pool cleaner, a back-edge portion having a substantially-vertical surface securable to a wall, and hose-mounting portion(s) which has substantially-horizontal ledges defining open-sided notches. Each ledge is size to receive and support a hose section for uncoiled vertical storage.

7 Claims, 6 Drawing Sheets

POOL CLEANER STORAGE DEVICE

RELATED APPLICATIONS

The application claims the benefit of U.S. Provisional Application No. 60/817,729 filed on Jun. 30, 2006, the contents of which are incorporated by reference herein in their entirety.

FIELD OF THE INVENTION

The invention relates to devices for storage of pool-cleaner apparatus in their multiple and variable form.

BACKGROUND OF THE INVENTION

A number of problems exists with respect to the storage of automatic pool cleaners and related devices such as hoses. These problems are well-known to those who have or are involved with pool cleaners and, more specifically, to those who are involved in placement of pool cleaners for storage during periods of non-use and re-installation of pool cleaners after periods of non-use.

Various organization systems and devices have been developed. Examples of such prior art devices are those disclosed in the following United States patents: U.S. Pat. No. 6,102,215 (Guida), U.S. Pat. No. 5,988,408 (Evans et al.), U.S. Pat. No. U.S. Pat. No. 5,890,605 (Percudani), U.S. Pat. No. 5,690,235 (Matzen) and U.S. Pat. No. 4,583,647 (Schinzing).

Organization systems and devices in the prior art have certain shortcomings and disadvantages to which this invention is addressed. In particular, there is a need for a pool cleaner storage device which can provide convenient and compact storage of an automatic pool cleaner and related hose sections that is wall-mountable and easy to install. It would be desirable that a pool cleaner storage device also be able to prevent hose sections from becoming coiled and hence ruined.

OBJECTS OF THE INVENTION

It is an object of this invention to provide a pool cleaner storage device that overcomes some of the problems and shortcomings associated with the prior art.

Another object of this invention is to provide a pool cleaner storage device for convenient and compact storage of an automatic pool cleaner and related hose sections.

Another object of this invention is to provide a pool cleaner storage device that prevents hose sections from becoming coiled and hence ruined.

Another object of this invention is to provide a pool cleaner storage device that is easy to install.

Yet another object of this invention is to provide a pool cleaner storage device that is able to be mounted on a wall.

These and other objects of the invention will be apparent from the following descriptions and the drawings.

SUMMARY OF THE INVENTION

The invention is a wall-mountable device for convenient and compact storage of an automatic pool cleaner and related hose sections. The inventive device includes a body having a shelf portion with a substantially-horizontal upper surface sized to receive the pool cleaner thereon, a back-edge portion having a substantially-vertical surface securable to a wall, and hose mounting portion(s) having substantially-horizontal ledges defining open-sided notches each sized to receive and support a hose section for uncoiled vertical storage thereof.

Each hose section, of course, includes a connector end with hosing extending therefrom. In certain preferred embodiments of the invention, the notches are sized such that the ledges support the hose sections by the connector ends resting thereon. The body has non-back edge portions and at least one hose-mounting portion forms a non-back edge portion, thereby facilitating placement of hose sections for storage and removal thereof for use.

Preferably, the ledges are spaced below the upper surface whereby the connector ends are recessed with respect to the upper surface.

The aforesaid non-back edge portions preferably include (a) pair of opposed side-edge portions each formed by a hose-mounting portion and (b) a front edge portion.

The device preferably includes additional hose-mounting portions attached to and positioned below the shelf portion. Such additional hose-mounting portions have substantially-horizontal ledges defining open-sided notches each sized to receive and support a hose section for uncoiled vertical storage thereof.

Some embodiments of this invention also include hose-mounting portion(s) attached to and positioned below the shelf portion. Such additional hose-mounting portion(s) have substantially-horizontal ledges defining open-sided notches each sized to receive and support a hose section of uncoiled vertical storage thereof. Each notch is preferably sized for snap-engagement of a hose section therewith.

The body of the device is preferably a unitary molded structure, made using any of the wide variety of polymeric materials all of which are well-known to those skilled in the art of swimming-pool cleaner equipment.

BRIEF DESCRIPTIONS OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

FIGS. 1-6 illustrate a pool cleaner storage device 10 that is wall-mountable for convenient and compact storage of an automatic pool cleaner and related hose sections. The pool cleaner storage device 10 includes body 12 which has shelf portion 14 as shown in FIGS. 1-6.

Figure 1:
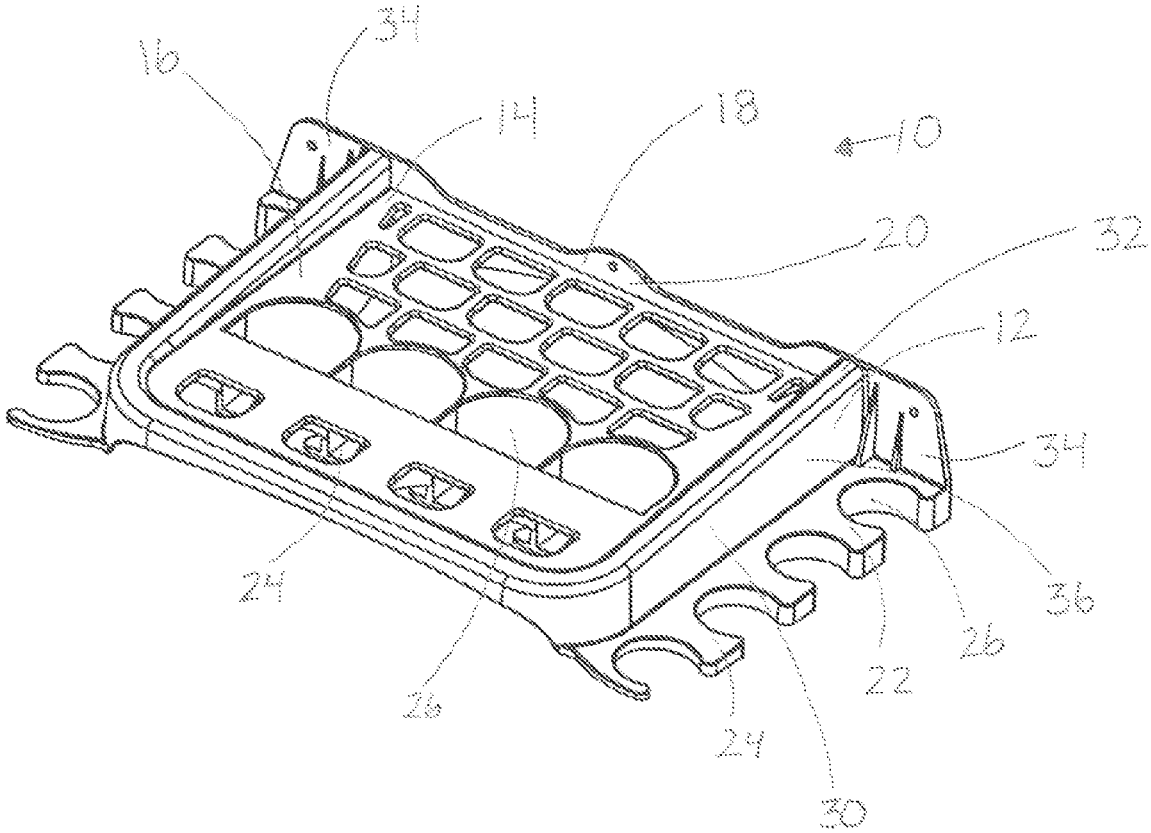
FIG. 1 is a perspective view from above of a pool cleaner storage device in accordance with this invention.
Figure 5:
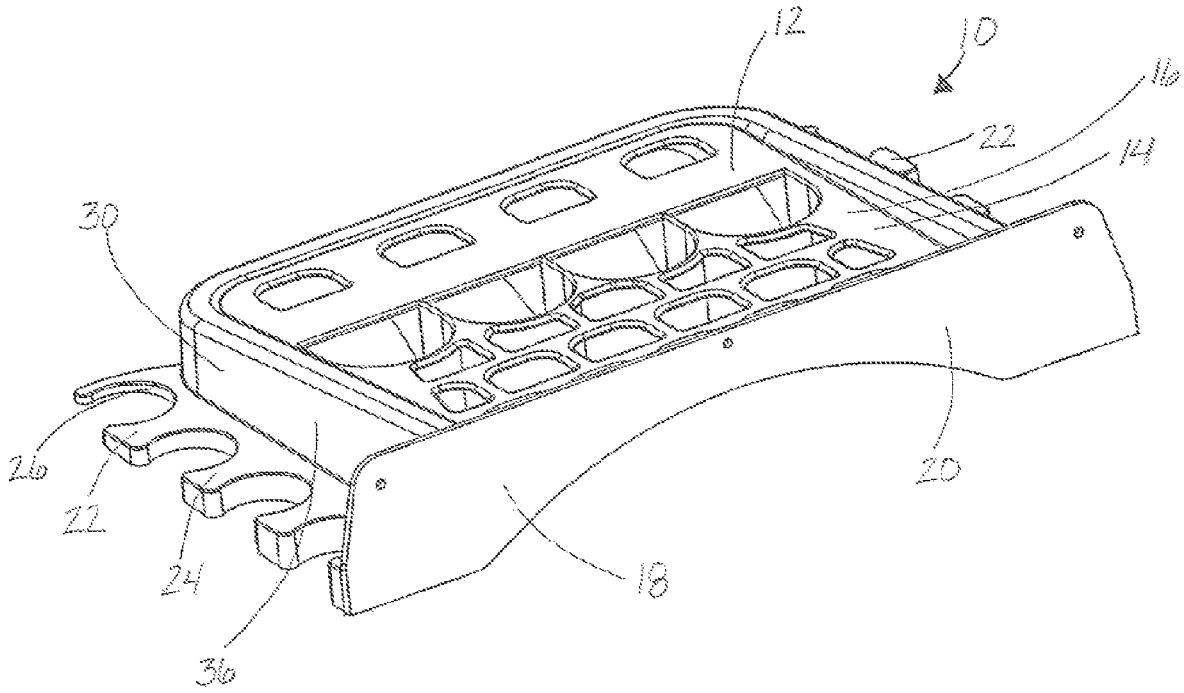
FIG. 5 is a perspective view from a back angle of the pool cleaner storage device of FIG. 1.

Shelf portion 14 has a substantially-horizontal upper surface 16 which is sized to receive and store a main pool cleaner body is illustrated in FIG. 1. Shelf portion 14 also includes a back-edge portion 18 which has a substantially-vertical surface 20 that can be secured to a wall as seen in FIG. 5.

Body 12 also includes hose-mounting portion(s) 22 which have substantially-horizontal ledges 24 as shown in FIGS. 1-6. The substantially-horizontal ledges 24 are spaced below upper surface 32 of pool cleaner storage device 10 as shown in FIGS. 1-6. The substantially-horizontal ledges 24 define open-sided notches 26 as illustrated in FIGS. 1-6. Each open-sided notch 26 is sized to receive and support a hose section for uncoiled vertical storage.

Figure 6:
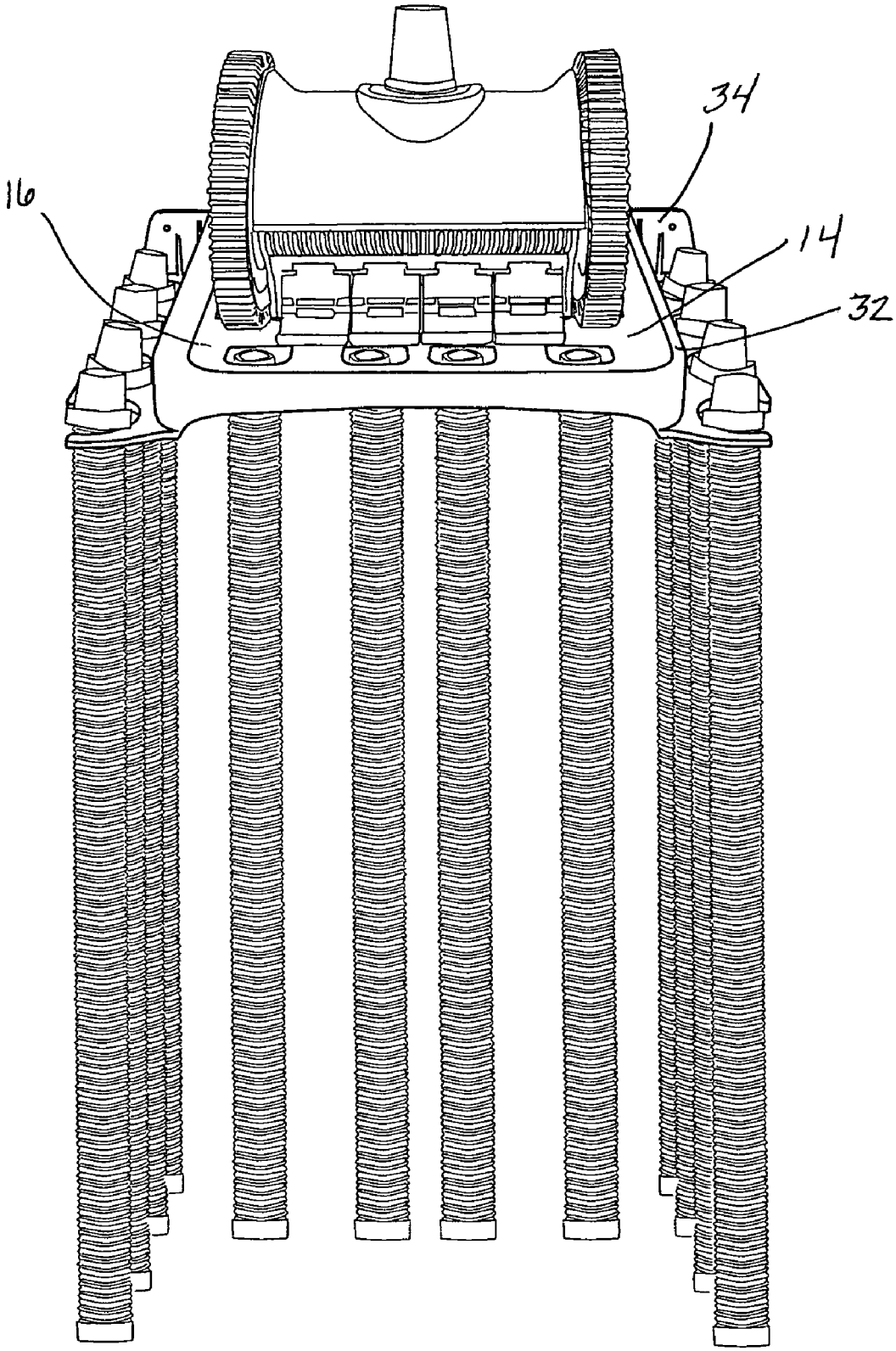
FIG. 6 is a perspective view of the pool cleaner storage device of FIG. 1 mounted and in use for storage.

Each hose section includes a connector end and each open-sided notch 26 is sized such that the substantially-horizontal ledges 24 support the hose section by the connector ends resting on them as shown in FIG. 6. Connector ends are recessed with respect to upper surface 32 when connector ends are engaged and resting in open-sided notches 26 as illustrated in FIG. 6.

Figure 2:
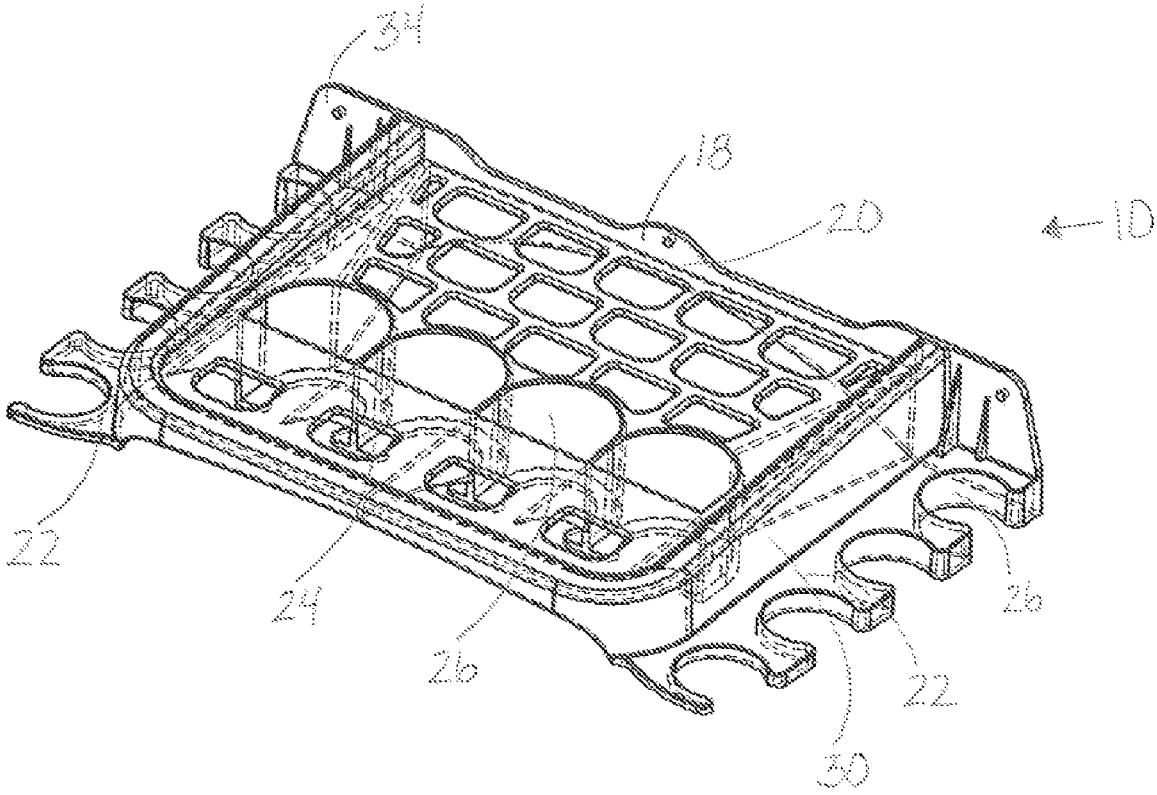
FIG. 2 is another similar perspective view, but with dotted lines further indicating characteristics and features of the pool cleaner storage device of FIG. 1.
Figure 3:
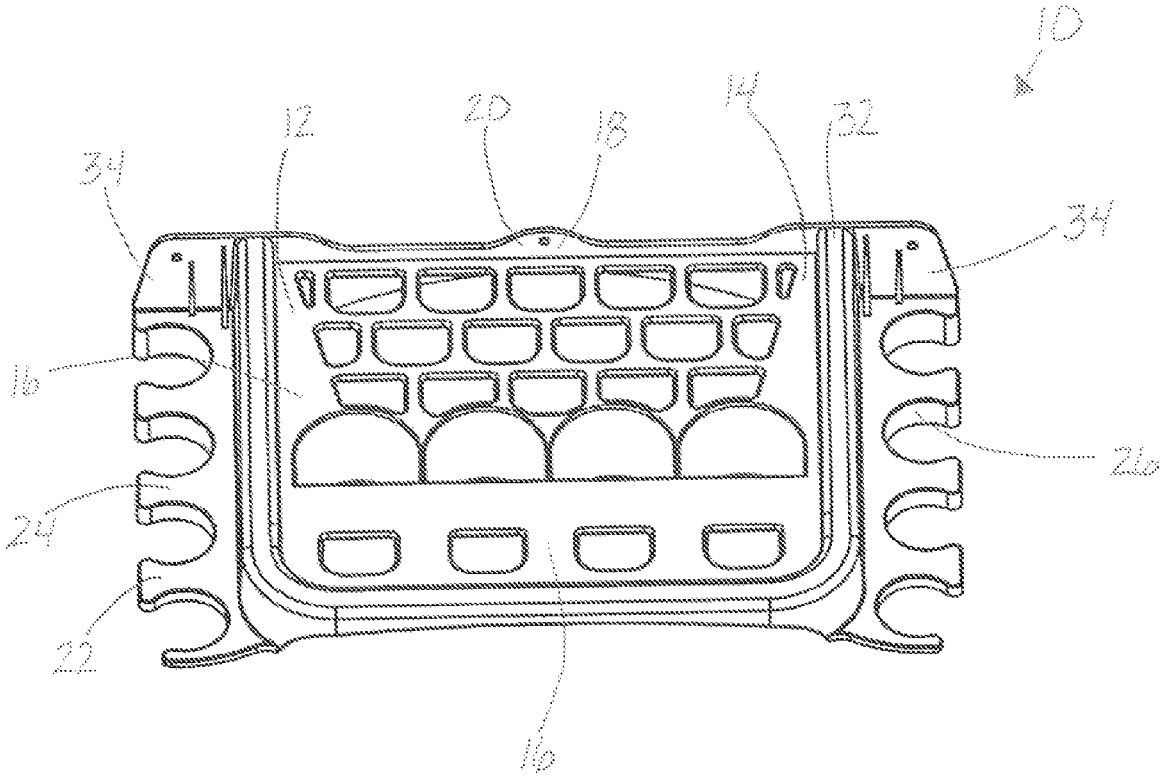
FIG. 3 is a front perspective view from above of the pool cleaner storage device of FIG. 1.
Figure 4:
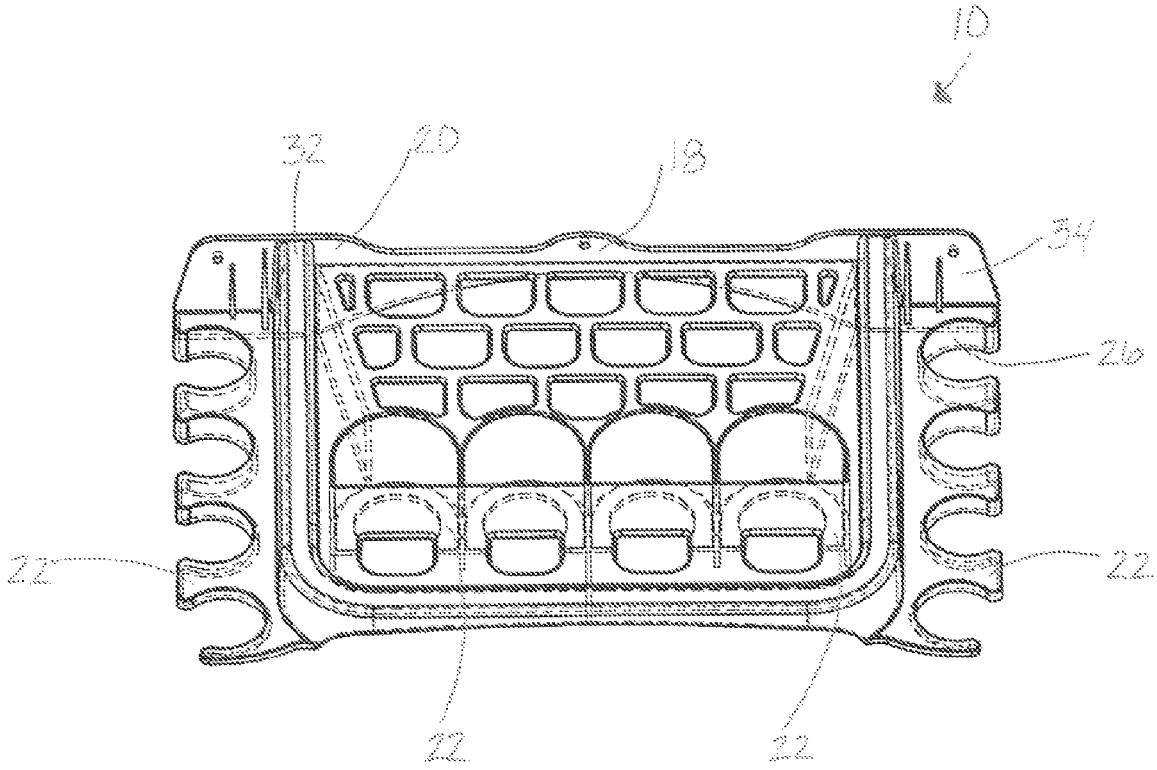
FIG. 4 is another similar front perspective view, but with dotted lines further indicating characteristics and features of the pool cleaner storage device of FIG. 1.

As shown in FIGS. 1 and 2, additional hose-mounting portions 22 are attached to and positioned below shelf portion 14. These additional hose-mounting portions 22 also include substantially-horizontal ledges 24 which have open-sided notches 26 as illustrated in FIGS. 1-6. Every open-sided notch 26 is sized to receive and support a hose section for uncoiled vertical storage. As shown in FIG. 6 open-sided notches 26 are sized for snap-engagement with hose section.

As illustrated in FIGS. 1-6 body 12 has non-back edge portions 30 which are formed by at least one hose-mounting potion 22. Non-back edge portions 30 further include a pair of opposed side-edge portions 34 each opposed side-edge portion 34 is formed by a hose-mounting portion 22 and a front edge portion 36. Non-back edge portions 30 allow for placement of hose sections for storage and removal thereof for use. Body 12 of pool cleaner storage device 10 is a unitary molded structure preferably made of common plastic materials.

A wide variety of materials are available for the pool cleaner storage device as discussed and illustrated herein.

While the principles of this device have been described in connection with specific embodiments, it should be understood clearly that these descriptions are made only by way of example and are not intended to limit the scope of the invention.

The invention claimed is:

1. A combined wall-mountable storage device and, stored thereon, an automatic pool cleaner and its related hose sections each having connector ends, the storage device of the combination having a body with a shelf portion having a substantially horizontal upper surface with the pool cleaner thereon, a back-edge portion having a substantially vertical surface securable to a wall, and at least one hose-mounting portion secured with respect to the shelf portion and having substantially horizontal ledges, each ledge having an upper ledge surface and defining open-sided hose-section notches each receiving and supporting one of the hose sections by snap-engagement to hold the hose section in place, the connector end of such hose section resting on the upper ledge surface, at least some of the notches having hose sections received therein and suspended therefrom in uncoiled vertical storage.

2. The combination of claim 1 wherein the body has at least one hose-mounting portion forming at least one non-back edge portion thereby facilitating placement of hose sections for storage and removal thereof for use.

3. The combination of claim 2 wherein the ledges are spaced below the upper surface and the connector ends are recessed with respect to the upper surface.

4. The combination of claim 2 wherein the non-back edge portions include (a) pair of opposed side-edge portions each formed by a hose-mounting portion and (b) a front edge portion.

5. The combination of claim 4 further including additional hose-mounting portions attached to and positioned below the shelf portion, such additional hose-mounting portions having substantially horizontal ledges defining open-sided hose-section notches each receiving and supporting a hose section for uncoiled vertical storage thereof.

6. The combination of claim 1 wherein the body is a unitary molded structure.

7. The combination of claim 1 wherein the body is a unitary piece.

* * * * *

UNITED STATES PATENT AND TRADEMARK OFFICE

CERTIFICATE OF CORRECTION

PATENT NO. : 7,506,770 B2
APPLICATION NO. : 11/770831
DATED : March 24, 2009
INVENTOR(S) : Dieter J. Rief It is certified that error appears in the above-identified patent and that said Letters Patent is hereby corrected as shown below:

Title Page, Item (74): Attorney, Agent, or Firm, delete “Jansso” and insert --Jansson--.
Title Page, Item (57) Abstract: line 1, delete “The” and insert --A--.
Title Page, Item (57) Abstract: line 4, delete “vertical” and insert --horizontal--.
Title Page, Item (57) Abstract: line 8, delete “size” and insert --sized--.
Column 1, line 28, after “No.”, delete second occurrence of “U.S. Pat. No.”.
Column 2, line 67, delete “is” and insert --as--.

Signed and Sealed this

Twenty-eighth Day of April, 2009

JOHN DOLL
*Acting Director of the United States Patent and Trademark Office*